US009247589B2

(12) United States Patent
Uchida et al.

(10) Patent No.: US 9,247,589 B2
(45) Date of Patent: Jan. 26, 2016

(54) INDUCTION HEATING DEVICE, INDUCTION HEATING METHOD, AND PROGRAM

(75) Inventors: Naoki Uchida, Tamano (JP); Yoshihiro Okazaki, Tamano (JP); Kazuhiro Ozaki, Tamano (JP)

(73) Assignee: MITSUI ENGINEERING & SHIPBUILDING CO., LTD., Tokyo (JP)

( * ) Notice: Subject to any disclaimer, the term of this patent is extended or adjusted under 35 U.S.C. 154(b) by 155 days.

(21) Appl. No.: 13/991,256

(22) PCT Filed: Dec. 3, 2010

(86) PCT No.: PCT/JP2010/071690

§ 371 (c)(1),
(2), (4) Date: Jun. 3, 2013

(87) PCT Pub. No.: WO2012/073379

PCT Pub. Date: Jun. 7, 2012

(65) Prior Publication Data

US 2013/0248520 A1 Sep. 26, 2013

(51) Int. Cl.
*H05B 6/04* (2006.01)
*H05B 6/08* (2006.01)
(Continued)

(52) U.S. Cl.
CPC .. *H05B 6/08* (2013.01); *H05B 6/06* (2013.01); *H05B 6/44* (2013.01); *H05B 6/04* (2013.01); *H05B 6/062* (2013.01)

(58) Field of Classification Search
CPC ..... H05B 6/04; H05B 6/06; H05B 6/062; H05B 6/02; H05B 6/362; H05B 6/36; H05B 6/102; H05B 6/105; C21D 1/42
USPC ..... 219/660, 661, 662, 663, 664, 665, 666, 219/667, 668, 669, 670, 671, 672, 673, 674, 219/675, 635, 655, 656
See application file for complete search history.

(56) References Cited

U.S. PATENT DOCUMENTS 4,467,165 A * 8/1984 Kiuchi et al. ..... 219/664
4,511,956 A * 4/1985 Dewan et al. ..... 363/49
(Continued)

FOREIGN PATENT DOCUMENTS

CN 1631056 A 6/2005
JP 2004-71444 A 3/2004
(Continued)

OTHER PUBLICATIONS

JP201033923A Machine Translation; Uchida Naoki, Ozaki Kazuhiro; Induction Heating Method and Induction Heating Device; Dec. 2, 2010.*
(Continued)

*Primary Examiner* — David Angwin
*Assistant Examiner* — Hemant Mathew
(74) *Attorney, Agent, or Firm* — Squire Patton Boggs (US) LLP

(57) ABSTRACT

The purpose of the present invention is to minimize switching losses of an inverter. An induction heating device includes: a plurality of induction heating coils (20) which are disposed adjacent with each other; a plurality of inverters (30), each of which has a capacitor (40) serially connected to each of the induction heating coils (20), and converts a DC voltage into a square wave voltage; and a control circuit (15) which controls so as to align the phase of coil currents flowing though the plurality of the induction heating coils (20), wherein the control circuit (15) controls the timing at which the square wave voltage transitions such that an instantaneous value of the square wave voltage is preserved in either the DC voltage or a turnover voltage, when the coil current zero crosses.

8 Claims, 8 Drawing Sheets

(51) Int. Cl.
*H05B 6/44* (2006.01)
*H05B 6/06* (2006.01)

(56) References Cited

U.S. PATENT DOCUMENTS

| | | | | | |
|---|---|---|---|---|---|
| 6,163,019 | A * | 12/2000 | Green et al. | ..... | 219/660 |
| 2005/0199614 | A1 * | 9/2005 | Uchida et al. | ..... | 219/662 |

FOREIGN PATENT DOCUMENTS

| | | | | |
|---|---|---|---|---|
| JP | 2004-146283 | A | | 5/2004 |
| JP | 2007-26750 | A | | 2/2007 |
| JP | 2007-328918 | A | | 12/2007 |
| JP | 2010-33923 | A | | 2/2010 |
| JP | 2010033923 | A | * | 2/2010 |
| TW | 143743 | | | 10/1990 |
| TW | I295907 | B | | 4/2008 |
| WO | 2010/023978 | A1 | | 3/2010 |

OTHER PUBLICATIONS

Chinese Office Action application No. 201080070499.3 dated Oct. 8, 2014.
Taiwan Office Action application No. 099140319 dated Oct. 30, 2013.
International Search Report mailed Mar. 8, 2011 issued in corresponding International Application No. PCT/JP2010/071690.
Chapter 8 Resonance Type Converter Circuit, in "Power Electronics Circuit" compiled by Expert Committee on Semiconductor Power Conversion System Investigation, the Institute of Electrical Engineers of Japan (IEEJ) and published by Ohmsha (2000).
"Transistor Gijutsu" published by "CQ Publishing" Jun. 2004 Issue, p. 228.
German Patent and Trademark Office, Office Action for corresponding German Application No. 11 2010 006 045.2, Jul. 28, 2015.

* cited by examiner

INDUCTION HEATING DEVICE, INDUCTION HEATING METHOD, AND PROGRAM

CROSS REFERENCE TO RELATED APPLICATION

The present application claims benefit of the filing date of PCT Application No. PCT/JP2010/071690 filed on Dec. 3, 2010 which is incorporated herein by reference.

TECHNICAL FIELD

The present invention relates to an induction heating device, an induction heating method, and a program, using a plurality of induction heating coils.

BACKGROUND OF THE INVENTION

It is necessary for a semiconductor manufacturing apparatus for heat-treating wafers to control the temperature difference on the surface of the wafer as small as possible (e.g., within a range of plus or minus one degree Celsius) to avoid thermal strain and others. In addition, it is necessary to elevate the temperature fast (e.g., 100° C./s) to the desired temperature (e.g., 1350° C.). Accordingly, an induction heating device is widely known in which an induction heating coil is divided into a plurality thereof and a power control is performed by connecting a high-frequency power source (e.g., an inverter) to each of the divided induction heating coils individually. However, as each of the divided induction heating coils is disposed closely to each other, there are mutual induction inductances M, thereby generating mutual induction voltages. Therefore, each of the inverters is operated in parallel via a mutual inductance and it may cause a mutual power transfer between the inverters when having a mutual phase shift of electric current between the inverters. In other words, as a phase shift occurs in a magnetic field between the divided induction heating coils due to a phase shift of electric current between each of the inverters, magnetic fields in the vicinity of the boundary of the adjacent induction heating coils are weakened, thereby reducing the density of heat generated by an induction heating power. As a result, temperature variations may occur on the surface of the heated object (such as a wafer).

This prompted inventors and others to propose a technique of Zone Controlled Induction Heating (ZCIH) (e.g., refer to Japanese Patent Application Publication No. JP2007-026750A) to enable to appropriately control the induction heating power, by preventing a circulation current from mutually flowing between the inverters even under a situation where a mutual inductance exists due to a mutual induction voltage between the adjacent induction heating coils, as well as preventing heat density from degrading in the vicinity of the boundary of the divided induction heating coils. According to the technique of ZCIH, each power supply unit is provided with a step-down chopper and a voltage source inverter (hereinafter referred to simply an inverter). Then, each of the power supply units divided into a plurality of power supply zones is individually connected to each of the induction heating coils, respectively, for supplying power.

In this case, each of the inverters in each of the power supply units are controlled for synchronization of current (i.e., synchronization control of current phase), respectively, and by synchronizing phase of a current flowing in each of the inverters, a circulation current is prevented from flowing among the plurality of inverters. In other words, by suppressing electric current among the plurality of inverters, an over-voltage generated by the regenerative electric power flowing to the inverter is avoided. In addition, by synchronizing the current phase flowing in each of the divided induction heating coils, heat density by induction heating power is intended not to be degraded rapidly in the vicinity of the boundary of each of the induction heating coils. Furthermore, by varying input voltage of each of the inverters, each of the step-down choppers controls the current amplitude of each of the inverters, thereby controlling the induction heating power supplied to each of the induction heating coils. That is, in a technique of ZCIH disclosed in Japanese Patent Application Publication No. JP2007-026750A, by performing current amplitude control for each step-down chopper, power of the induction heating coil is controlled in each zone, and by controlling synchronization of current phase of each inverter, circulating current among the plurality of inverters is suppressed and the density of the heat generated by the induction heating power is homogenized in the vicinity of the boundary of each of the induction heating coils. By the control system for the step-down chopper and the control system for the inverter performing control individually using such a ZCIH technique, it is possible to control heat distribution on the object to be heated as desired. That is, it is possible to perform rapid and precise temperature control and heat distribution control, using the ZCIH technique disclosed in Japanese Patent Application Publication No. JP2007-026750A.

Further, a technique is disclosed in Japanese Patent Application Publication No. JP2004-146283A for supplying DC power at the same time to each of inverters connected, respectively, to each of a plurality of induction heating coils, thereby running a plurality of induction heating coils concurrently. Specifically, this technique is adapted to detect the zero crossing of the output current from each of inverters connected to each of series resonant circuits, respectively, to compare the zero-cross timing of the output current of each of the inverters and the rising timing of the reference pulse. This technique is intended to synchronize the output current from each of the inverters, by adjusting the frequency of the output current so that a phase shift from the reference pulse, calculated individually by comparison, becomes zero or close to zero. In addition, this technique controls the current flowing through the induction heating coil after the output current of each inverter is synchronized, by increasing and decreasing the output voltage of the inverter, and conducts homogenized heat distribution of the object to be heated.

Chapter 8 Resonance Type Converter Circuit, in "Power Electronics Circuit" compiled by Expert Committee on Semiconductor Power Conversion System Investigation, the Institute of Electrical Engineers of Japan (IEEJ) and published by Ohmsha, describes a resonance type converter circuit that has a resonant current phase lag mode, in which the phase of the output current from the inverter is behind relative to the output voltage of the inverter, and a resonant current phase lead mode, in which the phase of the output current from the inverter is ahead relative to the output voltage of the inverter. It describes that a resonance type converter circuit in a resonant current phase lead mode is turned on in the zero-current switching, and that a reverse recovery current of a commutation diode is added to the resonant current as a current flowing through the switching element, due to the reverse recovery operation of the commutation diode at turn-on of the switching element, which results in the increase in turn-on power loss of the switching element. It also describes that a resonance type converter circuit in a resonant current phase lag mode, on the other hand, becomes zero-current switching at a turn-on operation and hard switching at a turn-off operation, where a turn-off operation in hard switching can be improved as Zero Voltage Switching (ZVS), by connecting a lossless capacitor snubber in parallel with the switching element.

Further, "Transistor Gijutsu", CQ Publishing, June 2004 Issue, p. 228, discloses a full bridge circuit that achieves a ZVS operation to stably drive an inductance load, by shunting an output at zero-crossing of a current thus avoiding a state that a switching element becomes open.

SUMMARY OF INVENTION

Description of Related Art

In order to reduce a switching loss, an inverter using the technique disclosed in Japanese Patent Application Publication No. JP2007-026750A is used in a resonant current phase lag mode in which a zero-cross timing of turning over the direction of a sine-wave current flowing through an induction heating coil lags a rising timing of the driving voltage. However, if a pulse width of the square wave voltage is shortened in order to adjust the supply power (effective power) applied to the induction heating coil, a switching is sometimes performed in a resonant current phase lead mode in which a zero-cross timing of a sine-wave current zero-crossing from negative to positive is ahead of the rising timing of the driving voltage. Therefore, there is a problem that a reverse recovery current of the commutation diode is added to the current flowing through the switching element, when the switching element in the inverter (inverse conversion device) is turned on, thereby increasing switching loss.

Accordingly, the present invention has been made to solve such a problem, by providing an induction heating device, induction heating method and a program capable to reduce a switching loss at the inverter regardless of the pulse width.

Means for Solving Problem

To achieve the above objective, an induction heating device (100) according to the present invention is provided with: a plurality of induction heating coils (20) which are disposed adjacent with each other; capacitors (40) each of which is connected in series to each of the induction heating coils; a plurality of inverters (30) each of which applies a high frequency voltage converted from a DC voltage to each series circuit of the induction heating coil and the capacitor; and a control circuit (15) for performing the pulse width control of the high frequency voltages, as well as controlling the plurality of the inverters to align the phase of coil currents flowing through each of the plurality of the induction heating coils, wherein each of the DC voltage is common for the plurality of the inverters. The numbers in parentheses are illustrative.

In order to adjust an effective power supplied to each of the induction heating coils, instead of shortening the pulse width of the square wave voltage at inverters having low output power without changing the DC voltage, the pulse width of the high frequency voltage (square wave voltage) is prolonged at inverters having high output power, by lowering the DC voltage applied in common to each of the inverters. Thus, as each of the inverters is driven in the resonant current phase lag mode, while avoiding the resonant current phase lead mode, the switching loss is reduced regardless of the pulse width of the high frequency voltage. In addition, as the output voltage of the inverter is stable at the zero-cross timing of the coil current, a surge voltage caused by the inductance load is reduced. Further, phase lag may be increased by raising a driving frequency, instead of prolonging the pulse width.

In addition, it is preferable for the DC voltage to be lowered so that the maximum pulse width of the high frequency voltage converted by the plurality of the inverters becomes equal to or greater than a predetermined value. According to the above, the DC voltage is controlled for an inverter producing large output having the pulse width of the voltage equal to or greater than a predetermined value so that a zero-cross timing at which the current flowing through the series circuit zero crosses from negative to positive is behind relative to a rising timing of the voltage applied to the series circuit, and thereby the inverter operates in the resonant current phase lag mode. On the other hand, an inverter producing small output having the pulse width of the voltage less than a predetermined value is operated in the resonant current phase lead mode, but accumulated loss or surge voltage is also small due to small output, and thereby destruction of the transistor is avoided.

Each of the arms 14 in the inverter is provided with a transistor (e.g., FET, IGBT) and a diode in back-to-back connection, and the DC voltage is generated by a chopper circuit or a converter.

In addition, it is preferable that an abnormal stop unit, which is capable to stop the inverter when the high frequency voltage rises after the coil current zero-crosses from negative to positive, is further provided. By using the above unit, it is possible to avoid heat generated by a switching loss or breakage caused by a surge current.

It is also preferable that the plurality of the induction heating coils are disposed in proximity to a common heating element and the control circuit variably controls the pulse width of the square wave voltage so that electromagnetic energies supplied to the heating element by each of the induction heating coils are uniformed.

Effects of Invention

According to the present invention, the switching loss of the inverter is reduced regardless of the pulse width. Surge voltage during switching is also reduced.

BRIEF DESCRIPTION OF DRAWINGS

FIG. 3A shows a two-zone ZCIH of resonant circuits, each of which is composed of an induction heating coil and a capacitor, FIG. 3B shows an equivalent circuit of a zone, and FIG. 3C shows a vector diagram.

EMBODIMENTS OF INVENTION

First Embodiment

The configuration of an induction heating device of the present invention will be described with reference to FIG. 1 and FIG. 2.

Figure 1:
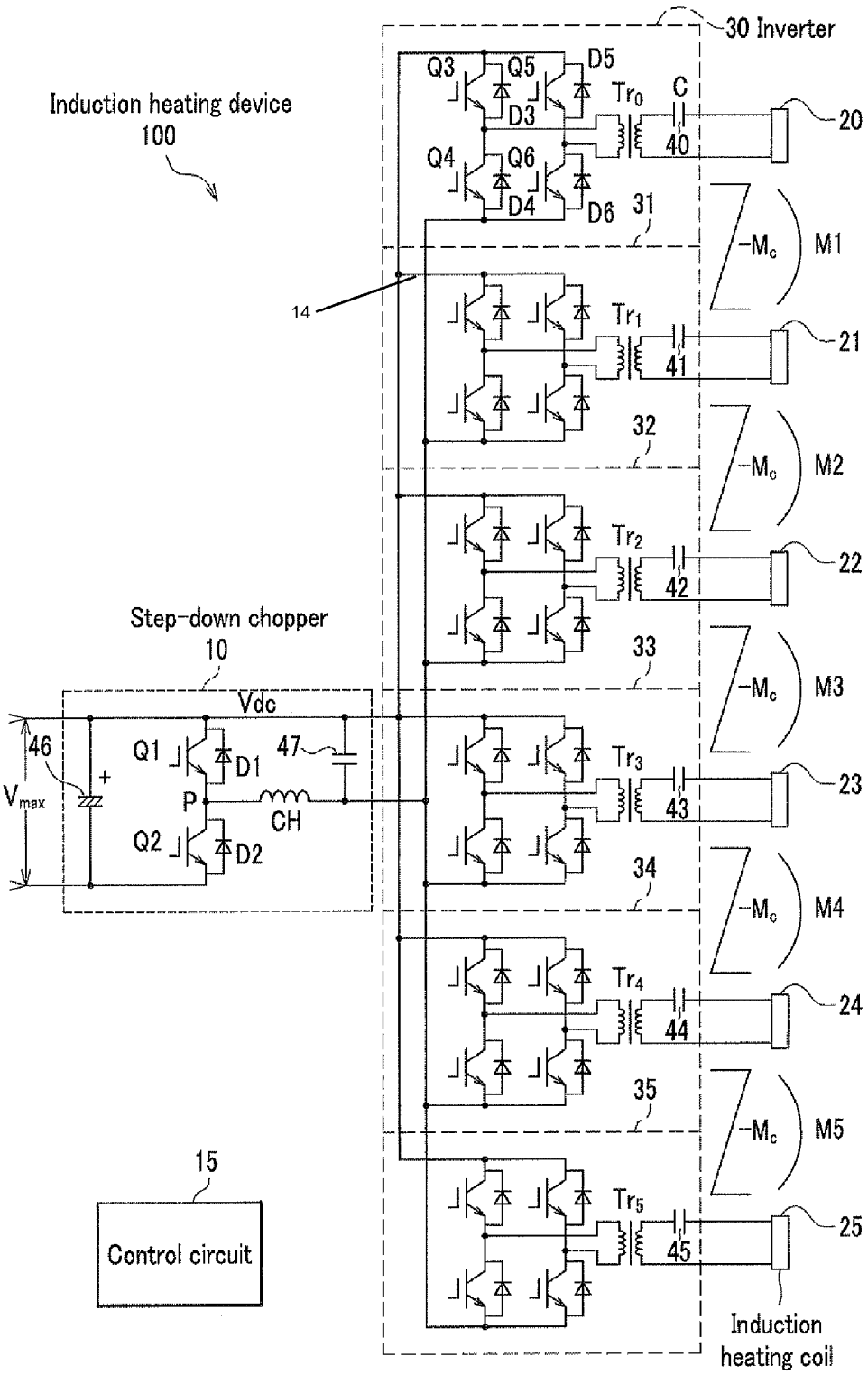
FIG. 1 is a circuit diagram of an induction heating device according to a first embodiment of the present invention.
Figure 2:
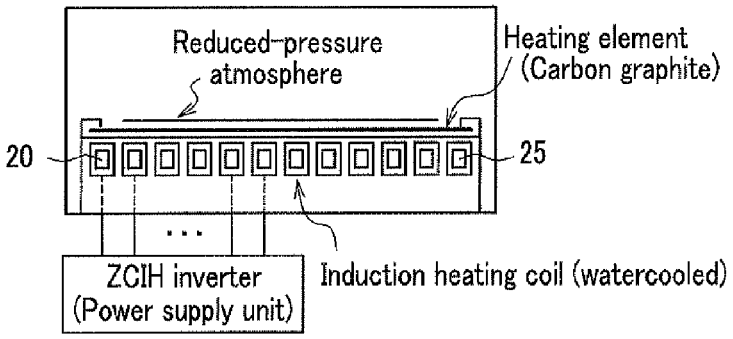
FIG. 2 is a cross-sectional view of the heating unit of the induction heating device according to the first embodiment of the present invention.

In FIG. 1, the induction heating device 100 includes a step-down chopper 10, a plurality of inverters 30, 31, . . . , 35, a plurality of induction heating coils 20, 21, . . . , 25, and a control circuit 15, wherein each of the induction heating coils 20, 21, . . . , 25 flows an eddy current in a common heating element (e.g., carbon graphite) (FIG. 2) by generating a high-frequency magnetic flux, thereby heating the heating element.

In addition, the induction heating device 100 is controlled to synchronize current phases and the frequencies of all induction heating coils 20, 21, . . . , 25, in order to reduce the influence of the mutually induced voltage by induction heating coils adjacent to each other. As the current phases of induction heating coils 20, 21, . . . , 25 are controlled to be aligned and there is no phase difference in generated magnetic fields, there is no such thing that the magnetic fields are weakened in the vicinity of the boundary of the induction heating coils adjacent to each other, thereby the density of the heat generated by an induction heating power is not decreased. As a result, temperature variations are eliminated on the surface of an object to be heated.

Furthermore, in order to reduce a switching loss, the inverters 30, 31, . . . , 35 are driven in resonant current phase lag mode, by making the driving frequency higher than the resonant frequency between the equivalent inductance of the induction heating coils 20, 21, . . . , 25 and the capacitance of the capacitor C connected in series.

Next, the object to be heated will be described with reference to FIG. 2. FIG. 2 is a block diagram of a Rapid Thermal Annealing (RTA) device used in the heat treatment of wafers. The RTA device includes a heat-resistant plate having a plurality of induction heating coils 20, 21, . . . , 25 buried in a recess portion, a common heating element provided on the surface of the heat-resistant plate, and a ZCIH inverter including an inverter 30 (FIG. 1) and a step-down chopper 10 (FIG. 1), wherein the heating element is divided into several zones (e.g., six zones) to be heated by the plurality of the induction heating coils 20, 21, . . . , 25. The RTA device is configured to generate heat in the heating element, by each of the induction heating coils 20, 21, . . . , 25 generating a high-frequency magnetic flux, the high-frequency magnetic flux flowing an eddy current in the heating element made of carbon graphite, for example, and the eddy current flowing through the resistance component of the carbon graphite. In other words, the RTA device is configured to heat the object to be heated such as a glass substrate or a wafer, by radiant heat of the heating element that is generated by each of the induction heating coils 20, 21, . . . , 25 generating a high-frequency electromagnetic energy and then the heating element generating heat by the electromagnetic energy. Note that the heating is performed in a reduced-pressure atmosphere in case of a semiconductor heat treatment.

Figure 3A:
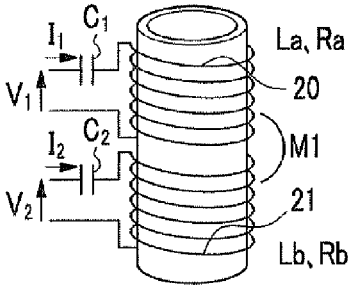
FIGS. 3A, 3B and 3C depict a resonant circuit consisting of an induction heating coil and a capacitor, and an equivalent circuit thereof, where

Further, a resonant circuit as shown in FIG. 3A will be described, considering only induction heating coils 20, 21 adjacent to each other. The induction heating coils 20, 21 include the inductive component of the equivalent inductances La, Lb and the resistive component of the equivalent resistances Ra, Rb, and voltages $V_1$, $V_2$ are applied via capacitors $C_1$, $C_2$. In addition, the induction heating coils 20, 21 are adjacent to each other, thereby bound by a mutual induction inductance M (M1). Here, the equivalent resistances Ra, Rb are the values of the equivalent resistance of the carbon graphite for eddy currents flowed through by the high-frequency magnetic flux of the induction heating coils 20, 21.

Note that $I_1$ is a current flowing through the induction heating coil 20 in zone 1, $V_1$ is an output voltage of an insulated transformer $Tr_0$, $I_2$ is a current flowing through the induction heating coil 21 in zone 2, and $V_2$ is an output voltage of an insulated transformer $Tr_1$.

Figure 3B:
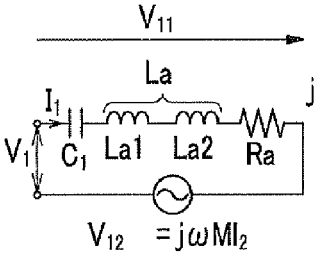
Figure 3C:
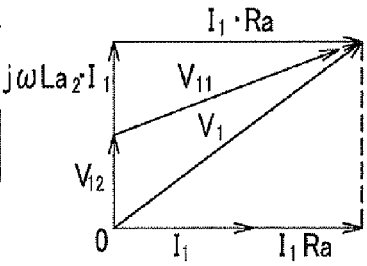

Next, FIG. 3B represents an equivalent circuit for a zone of the resonant circuit shown in FIG. 3A. The equivalent circuit is represented by a circuit, wherein a series circuit of a capacitance C1, equivalent inductances La1 and La2, and an equivalent resistance value Ra is driven by a vector sum of a voltage $V_1$ and a mutual induction voltage $V_{12}=j\omega MI_2$. Here, an equivalent inductance La has a relationship of La=La1+La2. In the resonance state wherein a driving frequency f of an inverter matches the resonance frequency $1/(2\pi\sqrt{(La1*C1)})$, the equivalent circuit is represented by a circuit driven by a vector sum of the voltage $V_1$ of a series circuit having the equivalent inductance La2 and the equivalent resistance value Ra, and the mutual induction voltage $V_{12}=j\omega MI_2$. That is, when expressed in a vector diagram FIG. 3C, the output voltage $V_1$ of the transformer $Tr_0$ is a vector sum of the vector voltage $V_{11}$ by the equivalent inductance La2 and the equivalent resistance value Ra, and the mutual induction voltage $V_{12}$, as well as a vector sum of the voltage $Ra*I_1$ and the voltage $(V_{12}+j\omega La2*I_1)$.

Note that each pair of the adjacent induction heating coils 20, 21, . . . , 25 is coupled with mutual induction inductances M1, M2, . . . , M5, respectively, in FIG. 1, then reverse coupled inductors (−Mc) may be connected in order to reduce the influence of these couplings. The inductance of each of the reverse coupled inductors (−Mc) is, for example, equal to or less than 0.5 μH that can be gained by one turn or core penetration.

A step-down chopper 10 is a DC/DC converter including an electrolytic capacitor 46, a capacitor 47, IGBTs (Insulated Gate Bipolar Transistors) Q1, Q2, commutation diodes D1, D2 and a choke coil CH, and converts a high DC voltage Vmax, which is rectified and smoothed from the commercial power supply (not shown), to a predetermined low DC voltage Vdc under duty control. In this case, the step-down chopper 10 outputs a low DC voltage Vdc of which the maximum pulse width of a square wave voltage (high frequency voltage) converted by the inverters 30, 31, . . . , 35 is equal to or greater than a predetermined value. The predetermined value is set so that the zero-cross timing of the coil current flowing through the induction heating coils 20, 21, . . . , 25 is behind the rising timing of the driving voltage for large output inverters having the pulse width of the output voltage equal to or greater than the predetermined value, and the zero-cross timing of the coil current is ahead of the rising timing of the driving voltage for small output inverters having the pulse width of the output voltage less than the predetermined value. In this case, accumulated loss occurs at small output inverters, but switching loss is small due to small output voltage, and surge voltage is also small.

Here, a predetermined value of the pulse width of the voltage is set to the low DC voltage Vdc being ½ of the high DC voltage Vmax, for example. Note that the maximum output voltage of the step-down chopper 10 is controlled at duty cycle of 95%, thereby avoiding an instantaneous short-circuit state.

At the step-down chopper 10, the high DC voltage Vmax, which is rectified and smoothed, is charged across the positive electrode and the negative electrode of the electrolytic capacitor 46, and an emitter of the IGBT Q1 and a collector of the IGBT Q2 are connected at the junction point P, to which one end of the choke coil CH is connected and the other end is connected to one end of the capacitor 47. The other end of the capacitor 47 is connected to a collector of the IGBT Q1 and the positive electrode of the electrolytic capacitor 46. In addition, the negative electrode of the electrolytic capacitor 46 is connected to an emitter of the IGBT Q2.

Next, an operation of the step-down chopper 10 will be described.

The IGBTs Q1, Q2 are on-off controlled alternately, by the control circuit 15 applying a square wave voltage to gates. First, when the IGBT Q1 is turned off and the IGBT Q2 is turned on, the charging of the capacitor 47 is initiated via the choke coil CH. And then, when the IGBT Q1 is turned on and the IGBT Q2 is turned off, the current flowing through the choke coil CH is discharged via the commutation diode D1. By repeating this charging and discharging at a predetermined DUTY ratio, the voltage across both ends of the capacitor 47 is converged to a low DC voltage Vdc determined by the high DC voltage Vmax and the DUTY ratio.

Each of the inverters 30, 31, . . . , 35 is a driving circuit that includes each of a plurality of inverter circuits that performs switching of the low DC voltage Vdc across both ends of the capacitor 47, each of insulated transformers $Tr_0$, $Tr_1$, . . . , $Tr_5$ and each of capacitors 40, 41, . . . , 45, respectively, and flows a high frequency current, by generating a square wave voltage (high frequency voltage) from the common low DC voltage Vdc. Here, a secondary side of each of the insulated transformers $Tr_0$, $Tr_1$, . . . , $Tr_5$ is connected to a series circuit of each of the induction heating coils 20, 21, . . . , 25 and each of the capacitors 40, 41, . . . , 45, respectively. Each inverter circuit includes the IGBTs Q3, Q4, Q5, Q6 and commutation diodes D3, D4, D5, D6 connected in reverse parallel to each arm of the IGBTs Q3, Q4, Q5, Q6, respectively, and generates a square wave voltage controlled so as to have a same frequency and a same phase of coil currents by applying a square wave voltage to gates, thereby driving a primary side of the insulated transformers $Tr_0$, $Tr_1$, . . . , $Tr_5$.

The insulated transformers $Tr_0$, $Tr_1$, . . . , $Tr_5$ are provided to insulate the induction heating coils 20, 21, . . . , 25 and the inverter circuits from each other, and the induction heating coils 20, 21, . . . , 25 are also insulated from each other. In addition, the primary and secondary side voltages of the insulated transformers $Tr_0$, $Tr_1$, . . . , $Tr_5$ have the same waveform, and a square wave voltage is outputted. Also, the primary and secondary side currents have the same waveform.

As each of the capacitors 40, 41, . . . , 45 resonates with each of the induction heating coils 20, 21, . . . , 25, respectively, each having a capacitance C and equivalent inductances La1, Lb1, . . . , Le1, when the driving frequency f of each of the inverters almost matches each of the resonant frequencies $1/(2\pi\sqrt{(La1*C)})$, $1/(2\pi\sqrt{(Lb1*C)})$, . . . , $1/(2\pi(Le1*C))$, a sine-wave current flows in the output from each of the insulated transformers $Tr_0$, $Tr_1$, . . . , $Tr_5$, having a value of each of the fundamental wave voltages $V_1$, $V_2$, . . . , $V_5$ divided by a series impedance of each of equivalent inductances La2, Lb2, . . . , Le2 and each of equivalent resistances Ra, Rb, . . . , Re, respectively. As the equivalent inductances La2, Lb2, . . . , Le2 and the equivalent resistances Ra, Rb, . . . , Re are inductive loads, the phase of the sine-wave current is behind the phase of the fundamental wave voltage, and the phase lag increases with the increasing frequency of the fundamental wave voltage. Note that a harmonic current hardly flows, because the harmonic current does not become resonant state.

Note that, as the harmonic current does not flow, an effective power Peff of a distorted-wave voltage and current is represented by $$Peff=V1*I1*\cos\theta 1$$

using the fundamental wave voltage V1, the fundamental wave current I1, and the phase difference θ1 between the fundamental wave voltage V1 and the fundamental wave current I1. Therefore, the effective power Peff is represented by the effective power of the fundamental wave, when driving a series resonant circuit of the LCR with a square wave voltage which is a distorted-wave voltage.

Figure 4:
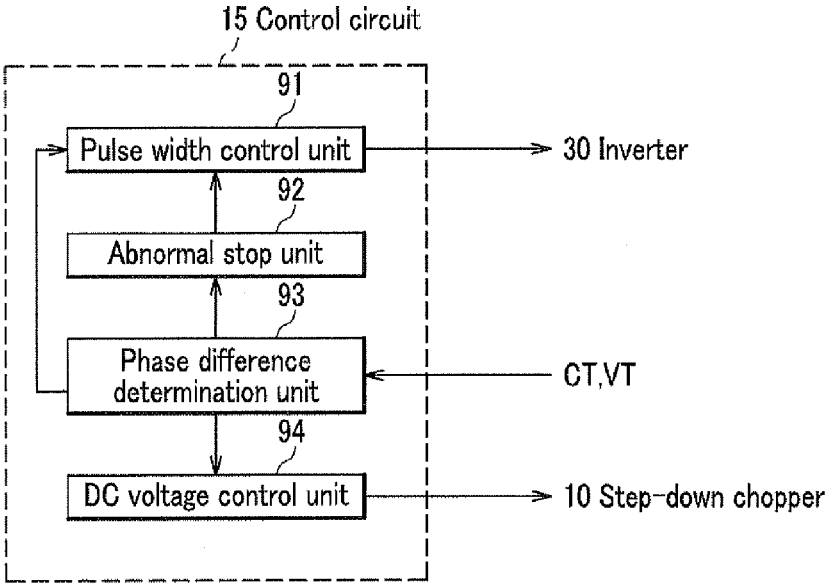
FIG. 4 is a block diagram of a control circuit used in the induction heating device according to the first embodiment of the present invention.

As shown in FIG. 4, the control circuit 15 includes a pulse width control unit 91, an abnormal stop unit 92, a phase difference determination unit 93, and a DC voltage control unit 94, wherein the pulse width control unit 91 generates a square wave voltage applied to the gates of the IGBTs Q3, Q4, Q5, Q6 in the inverter 30, and the DC voltage control unit 94 generates a square wave voltage applied to the gates of the IGBTs Q1, Q2 in the step-down chopper 10.

By observing a waveform of the square wave voltage generated by the inverter 30 using a VT (Voltage Transformer), as well as observing a waveform of each of the coil currents using a CT (Current Transformer), the phase difference determination unit 93 determines from above waveforms whether or not the phase is in lag mode. In other words, the phase difference determination unit 93 determines as a phase lag mode if the zero-cross timing, at which the coil current zero-crosses from negative to positive, is behind the rising timing of the square wave voltage, and determines as a phase lead mode if the zero-cross timing is ahead of the rising timing. Then, the phase difference determination unit 93 outputs the determination result to the pulse width control unit 91, the DC voltage control unit 94, and the abnormal stop unit 92 that will be described later.

As well as controlling the phase difference θ (FIG. 5) from the zero-cross timing of the fundamental wave of the square wave voltage to align the phase of the coil current (at the zero-cross timing) flowing through each of the induction heating coils 20, 21, . . . , 25, the pulse width control unit 91 controls the pulse width and the frequency so that the zero-cross timing of the coil current flowing through the series circuit is behind the rising timing of the square wave voltage. Here, the pulse width is variable by controlling a control angle 6 (FIG. 5) which is a difference between the zero-cross timing of the fundamental wave of the square wave voltage and the rising timing of the square wave voltage.

The operation of the pulse width control unit 91 will be described, using a voltage-current waveform diagram in FIG. 5.

Figure 5:
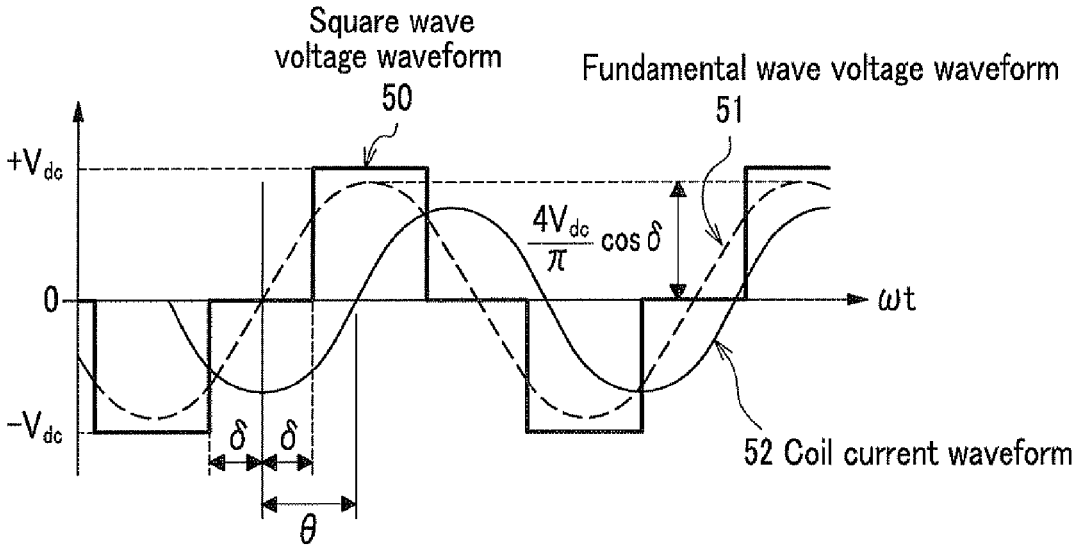
FIG. 5 is a waveform diagram for describing a control method when using a phase-shift control.

FIG. 5 shows a waveform of the square wave voltage, a waveform of the fundamental wave voltage and a waveform of the coil current, where the vertical axis is the voltage and current, while the horizontal axis is the phase (ωt). A square wave voltage waveform 50 at the secondary side of the transformer Tr is a waveform of a symmetric positive/negative odd function shown in a solid line, and the fundamental wave thereof is shown as a fundamental wave voltage waveform 51 in a broken line. The maximum amplitude of the square wave voltage waveform 50 is ±Vdc, and a phase angle of the control angle δ is set relative to a zero-crossing point of the fundamental wave voltage waveform 51. That is, both of the rising and falling timing of the square wave voltage waveform 50 and the zero-cross timing of the fundamental wave voltage waveform 51 have a phase difference with the control angle δ. In this case, the amplitude of the fundamental wave voltage waveform 51 is a 4 Vdc/π*cos δ.

In addition, the coil current waveform 52 shown in a solid line is a sine-wave that is behind the zero-cross timing of the fundamental wave voltage waveform 51 by phase difference θ. However, when the control angle δ of the square wave voltage waveform 50 is controlled as having a large value and the effective power supplied to the induction heating coils 20, 21, . . . , 25 is small, the zero-cross timing of the coil current waveform 52 may be ahead of the rising timing of the square wave voltage waveform 50.

Further, while aligning the phase difference θ of all of the coil currents flowing through each of the induction heating coils 20, 21, . . . , 25, the pulse width control unit 91 (FIG. 4) varies amplitude of the coil current for each of the induction heating coils. For this purpose, the pulse width control unit 91 controls the amplitude of the fundamental wave voltage, by changing the control angle δ with reference to the zero-cross timing of the fundamental wave voltage waveform 51. For this purpose, the pulse width control unit 91 changes the control angle δ so that the coil current becomes a predetermined value, using an ACR (Automatic Current Regulator). With this control, the influence of mutual induction voltages caused by adjacent coil currents is reduced, while changing the effective power applied to the induction heating coils.

For example, the square wave voltage having the longest pulse width is applied to the induction heating coil 20, and the square wave voltages having shorter pulse width are applied to other induction heating coils 21, 22, . . . , 25 in accordance with the amount of heating. That is, the maximum effective power is input to the induction heating coil 20, and less effective powers are input to the other induction heating coils 21, 22, . . . , 25 in accordance with the amount of heating.

In this case, shortening the pulse width of the square wave voltage may cause a resonant current phase lead mode in which the zero-cross timing of the coil current is ahead of the rising timing of the square wave voltage. If it happens, the zero-cross timing of the coil current may be delayed by increasing the driving frequency, or the control angle 6 may be reduced by decreasing the DC voltage Vdc.

The square wave voltage has a symmetric positive/negative and same pulse width, and low level sections, where an instantaneous voltage applied to the primary side of the insulated transformer Tr is zero, are set before and after the pulses, in order to equate the square wave frequency. Further, as the voltage applied to the primary side of the insulated transformer Tr is set to the symmetric positive/negative pulse with the same width, a DC bias magnetism is prevented at the insulated transformer Tr.

Figure 6A:
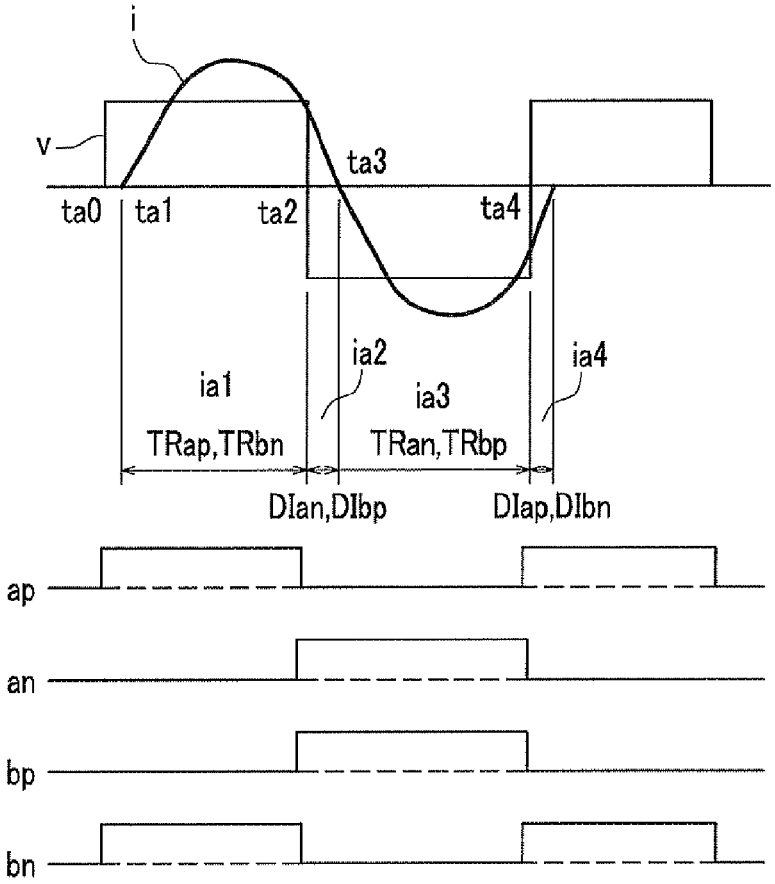
FIGS. 6A and 6B depict a waveform diagram, and a circuit diagram of the inverter showing current flows, in resonant current phase lag mode with a 100% duty cycle.
Figure 6B:
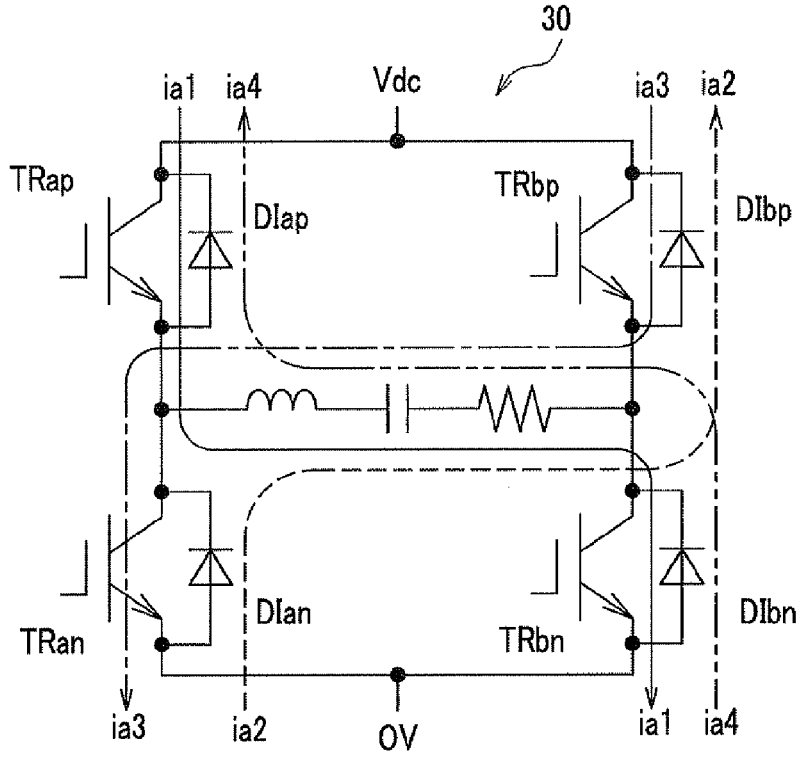

FIGS. 6A and 6B depict a waveform diagram and a circuit diagram of the inverter 30 to show current flows, respectively, in resonant current phase lag mode and with a 100% DUTY cycle. FIG. 6A depicts a waveform diagram of a voltage and a current with the control angle δ=0, that is, a 100% DUTY cycle, and FIG. 6B depicts a circuit diagram of the inverter 30 to show current flows.

In FIG. 6A, code v represents a square wave voltage waveform with a 100% DUTY cycle, and code i represents a sine-wave current flowing through the induction heating coil. The zero-cross timing of the current waveform i is behind the rising timing of the square wave voltage waveform v. In FIG. 6B, the inverter 30 includes IGBTs Q3 (TRap), Q4 (TRan), Q5 (TRbp), and Q6 (TRbn), and commutation diodes D3 (DIap), D4 (DIan), D5 (DIbp) and D6 (DIbn).

A low DC voltage Vdc is applied across collectors of transistors TRap, TRbp and emitters of transistors TRan, TRbn. An emitter of the transistor TRap and a collector of the transistor TRan are connected, and an emitter of the transistor TRbp and a collector of the transistor TRbn are connected. In addition, a series circuit of a coil having an equivalent inductance La2, a capacitor having a capacitance C, and a resistance having an equivalent resistance value Ra, is connected between the junction point of the emitter of the transistor TRap and the collector of the transistor Tran, and the junction point of the emitter of the transistor TRbp and the collector of the transistor TRbn. The series circuit of the coil, the resistance and the capacitor is an equivalent circuit as viewed from the input side of the transformers $Tr_0$, $Tr_1$, . . . , $Tr_5$.

Each of the commutation diodes DIap, DIan, DIbp, DIbn is respectively connected between the collector and the emitter that are arms of each of the transistors TRap, TRan, TRbp, TRbn.

In FIG. 6A, the transistors TRap, TRbn are in the ON state at a time ta1, and a coil current i (ia1) flows. At this time, a series circuit of the coil, the resistance and the capacitor works as an inductive load and the zero-cross timing of a sine-wave current is behind the rising timing of the square wave voltage v.

The transistors TRap, TRbn transition to the OFF state at a time ta2, and the transistors TRan, TRbp transition to the ON state. Thus, a coil current i (ia2) having the same direction as the coil current ia1 flows through the diodes DIan, DIbp. At this time, as each voltage across both ends of the transistors TRap, TRbn does not change, a zero volt switching is performed.

The coil current ia2 zero-crosses at a time ta3, and the direction of the coil current i is turned over. The turnover coil current i (ia3) flows through the transistors TRan, TRbp, and the transistors TRap, TRbn transition to the ON state and the transistors TRan, TRbp transition to the OFF state at a time ta4=ta0. Thus, the coil current ia4 having the same direction as the coil current ia3 flows through the diodes DIbn, DIap. At the time ta1, the coil current ia4 zero-crosses, and a turnover current ia1 flows through the transistors TRap, TRbn. As it is a zero-current switching in which the coil current ia4 zero-crosses, switching loss is small.

That is, in the transition at the time ta2, the transistor TRbn transitions from the ON state to the OFF state, but a carrier accumulation loss does not occur, because the applied voltage of the diode DIbn only changes from zero to a reverse bias voltage yet it is not a transition from a forward bias state to a reverse bias state. Also, in the transition at the time ta3, there is a discharge of accumulated charges due to the transition from a forward bias state of the diode DIbp to the ON state of the transistor TRbp, but a carrier accumulation loss does not occur, because it is a zero-current switching in which a forward bias current is zero.

Figure 7A:
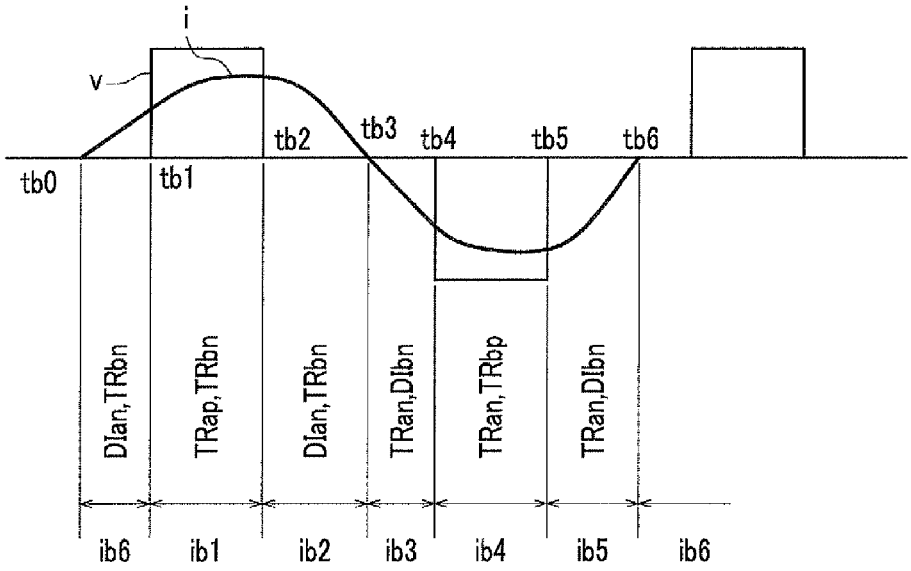
FIGS. 7A and 7B depict a waveform diagram, in resonant current phase lead mode with a duty cycle less than 100%.
Figure 7B:
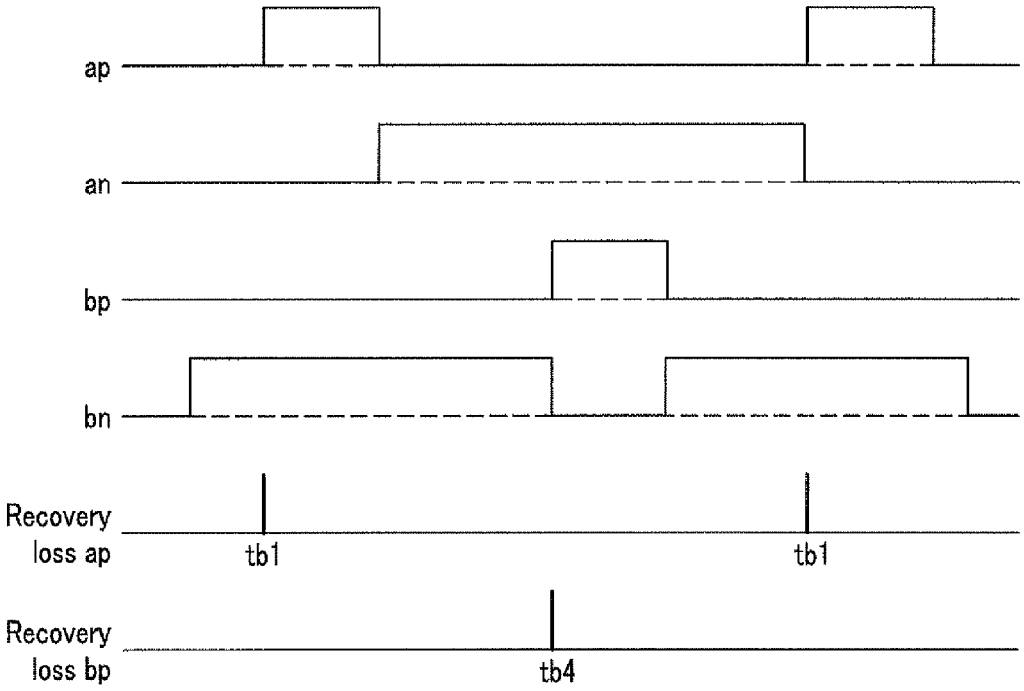
Figure 8A:
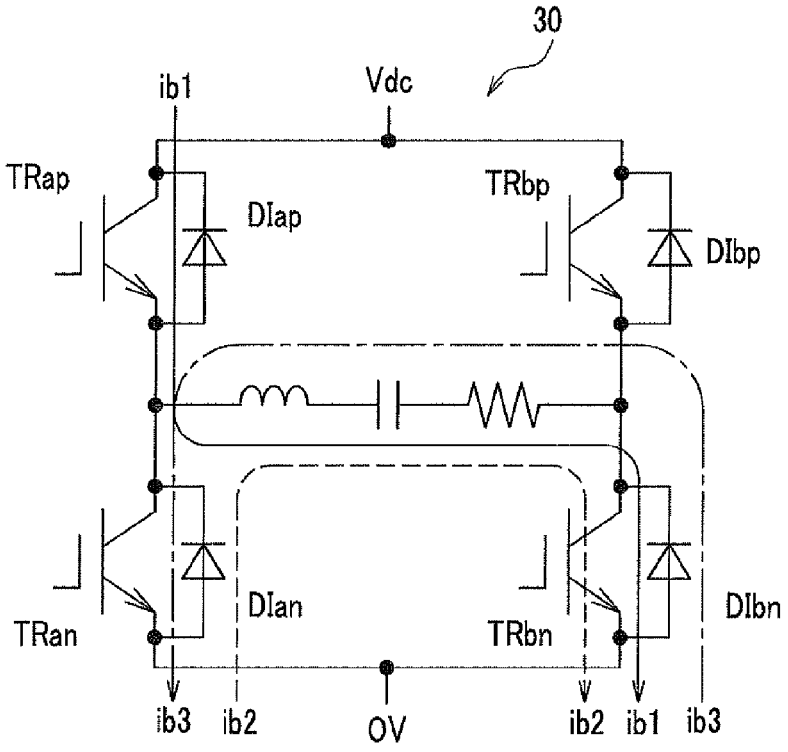
FIGS. 8A and 8B depict a circuit diagram of the inverter showing current flows, in resonant current phase lead mode with a duty cycle less than 100%.
Figure 8B:
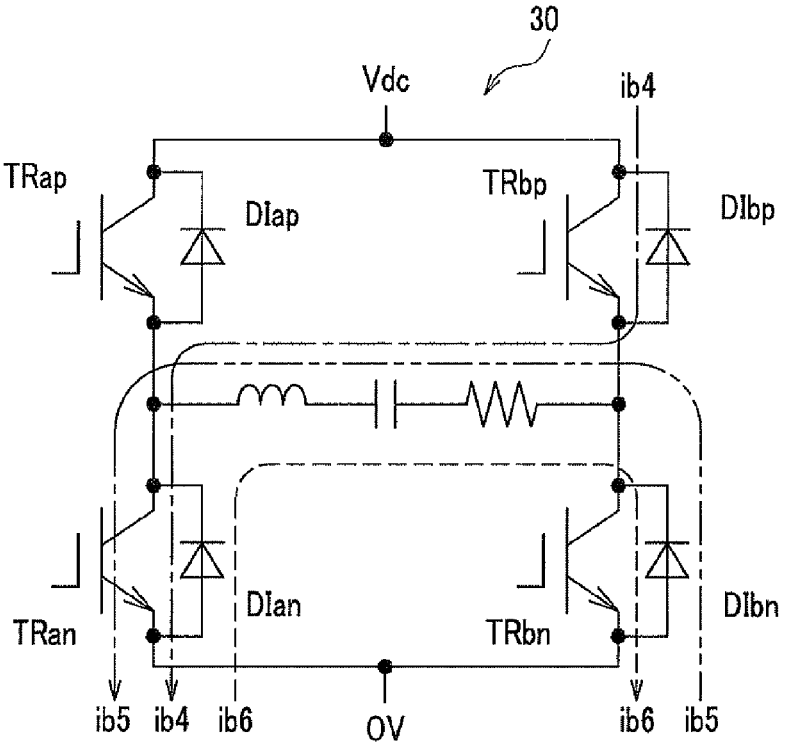

FIG. 7A is a waveform diagram in resonant current phase lead mode and with a DUTY cycle of less than 100%. FIG. 7A depicts a waveform diagram of a voltage and a current when a DUTY cycle is set to be less than 100%, by reducing the pulse width of the voltage, and FIG. 7B is a diagram showing a timing chart of the gate voltage. FIGS. 8A and 8B are circuit diagrams of the inverter 30 to show the current flows. As the circuit diagrams in FIGS. 8A, 8B are different from the circuit diagram in FIG. 6B only with respect to current flows, a description of the configuration will be omitted.

FIG. 7A is in a resonant current phase lead mode in which the zero-cross timing of the coil current i is ahead of the rising timing of the square wave voltage. The square wave voltage v has a positive value between a time tb1 and a time tb2, and a negative value between a time tb4 and a time tb5.

That will be described as follows with reference to the timing chart in FIG. 7B. Only the transistor TRbn is in the ON state from times tb0 to tb1, the transistors TRap, TRbn are in the ON state from times tb1 to tb2, the transistors TRan, TRbn are in the ON state from times tb2 to tb4, the transistors TRan, TRbp are in the ON state from times tb4 to tb5, and the transistors TRan, TRbn are in the ON state from times tb5 to tb6.

In other words, the coil current i is flowed by conducting the diagonally-located transistors Trap, TRbn or the other diagonally-located transistors TRbp, TRan, while no coil current is flowed during other time periods by rendering either one of the transistors TRan, TRbn at the lower arms in the ON state and other transistors in the OFF state, thereby preventing the induction heating coils 20, 21, . . . , 25 from falling into a floating state.

More specifically, a coil current ib1 flows through the transistors TRap, TRbn from the times tb1 to tb2, and a coil current ib2 having the same direction as the coil current ib1 flows through the diode DIan and the transistor TRbn from the times tb2 to tb3, at which time the coil current zero-crosses. A coil current ib3 having the reverse direction flows through the diode DIbn and the transistor TRan from the times tb3 to tb4. A coil current ib4 flows through the transistors TRan, TRbp from the times tb4 to tb5. A coil current ib6 flows through the diode DIan and the transistor TRbn from the times tb5 to tb6=tb0, at which time the coil current i zero-crosses.

At the times tb3 and tb0=tb6 when the coil current i zero-crosses, there is no change in the voltage across both terminals of the induction heating coils 20, 21, . . . , 25 and no power loss occurs. On the other hand, at the time tb4, the diode DIbn transitions to the reverse bias state, since the transistor TRbp transitions to the ON state after a forward current started to flow through the diode DIbn. Thus, a reverse bias current flows during the accumulation time at the diode DIbn, and a recovery loss (accumulated loss) occurs in the transistor TRbp. Similarly, at the time tb1, since the diode DIan transitions from the forward bias to the reverse bias, accumulated loss occurs in the transistor TRap. However, if the low DC voltage Vdc is low, the effect of the recovery loss is small.

Figure 9A:
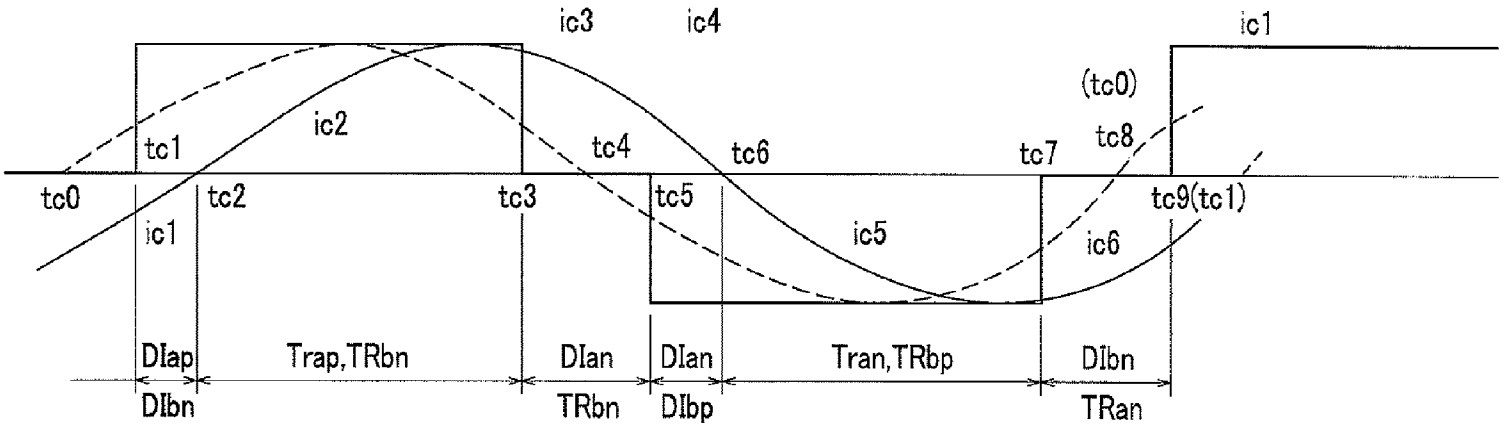
FIGS. 9A and 9B depict a waveform diagram, in resonant current phase lag mode with a duty cycle less than 100%.
Figure 9B:
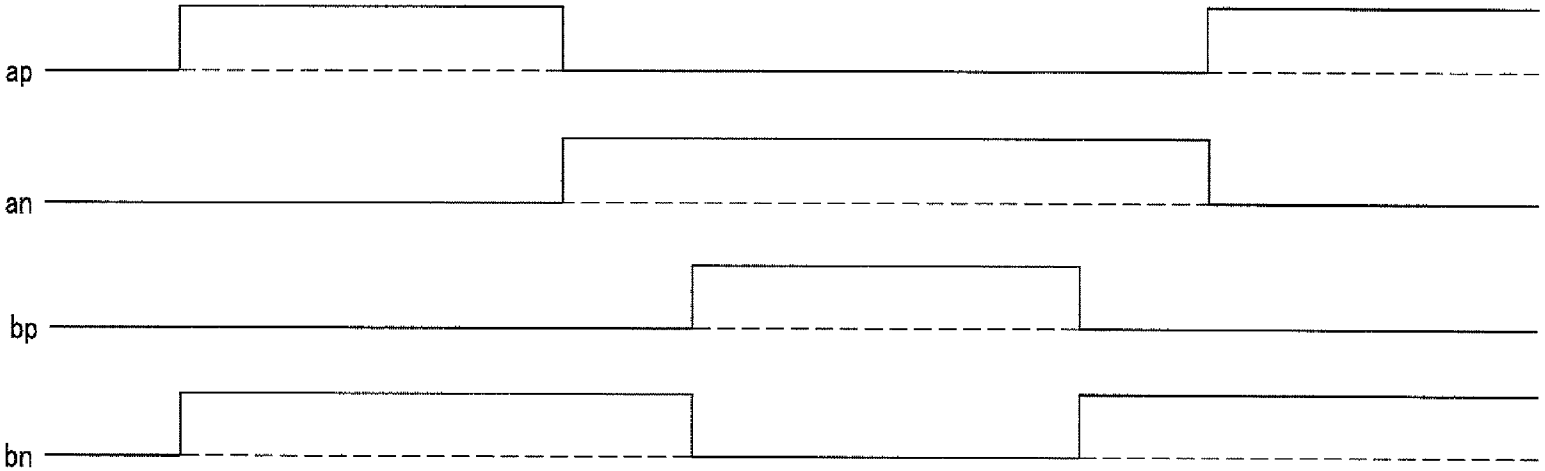
Figure 10A:
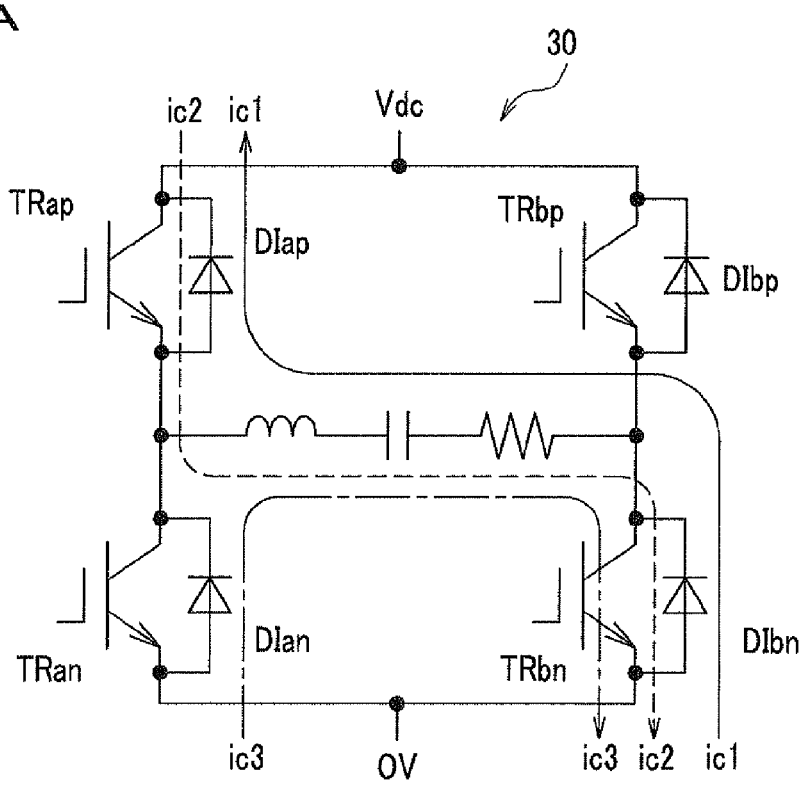
FIGS. 10A and 10B depict a circuit diagram of the inverter showing current flows, in resonant current phase lag mode with a duty cycle less than 100%.
Figure 10B:
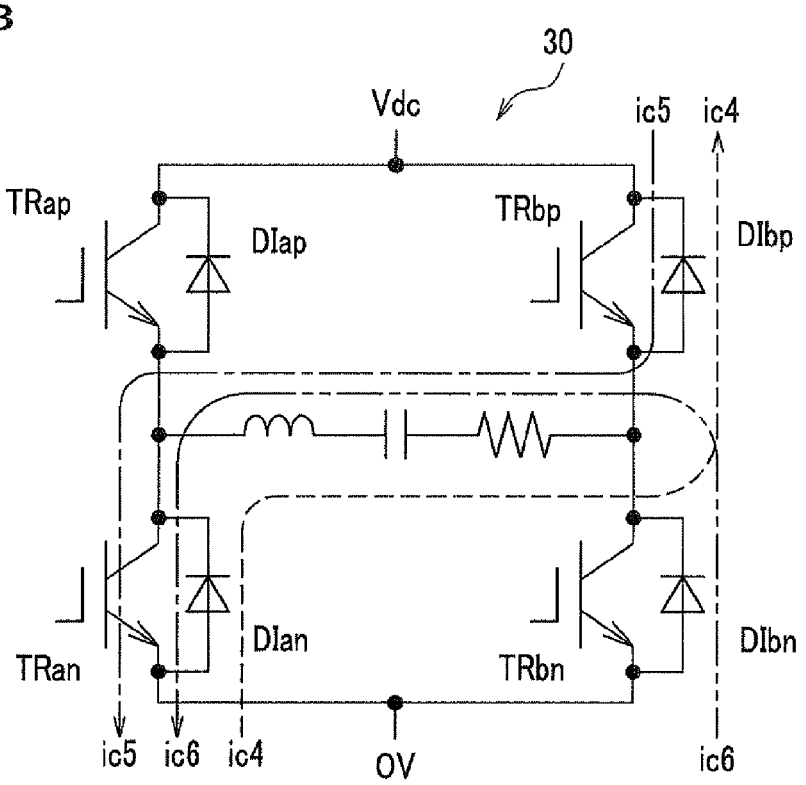

FIGS. 9A and 9B show a waveform diagram at a resonant current phase lag mode, with a DUTY ratio of less than 100%. FIG. 9A is a waveform diagram of voltage and current when the voltage width is reduced, where the dashed line shows the fundamental wave of the square wave voltage. Also at this time, the zero-cross timing of the current waveform i is behind the rising timing of the applied voltage v. Specifically, this is a case when the DUTY ratio is not 100% but the pulse width of the square wave voltage is wide. FIG. 9B is a diagram showing a timing chart of the gate voltage at that time. FIGS. 10A and 10B are circuit diagrams of the inverter 30 to indicate the current flow. Since the circuit diagrams in FIGS. 10A and 10B only differ from that in FIG. 6B with respect to current flows, a description of the configuration will be omitted.

In FIG. 9A, the transistors TRap and TRbn become a conductive state from times tc1 to tc3, the transistors TRan and TRbn become a conductive state from times tc3 to tc5, the transistors TRbp and TRan become a conductive state from times tc5 to tc7, and the transistors TRan and TRbn become a conductive state from times tc7 to tc9. Here, since the lower arm transistors TRan and TRbn are in conductive state from times tc3 to tc5 and from times tc7 to tc9, the voltage across the induction heating coil is zero, thereby causing no spike voltage.

The operation will be described using FIGS. 9A, 9B, 10A and 10B.

A negative sine-wave coil current ic1 flows through the diodes DIbn and DIap from the times tc1 to tc2, and the current zero crosses at the time tc2. A positive sine-wave coil current ic2 flows through the transistors Trap and TRbn from the times tc2 to tc3. A positive coil current ic3 flows through the diode DIan and the transistor TRbn from the times tc3 to tc5. In FIG. 10B, a positive coil current ic4 flows through the diodes Dian and DIbp from the times tc5 to tc6. Then, the coil current zero crosses at the time tc6. A negative coil current icy flows through the transistors TRbp and Tran from the times tc6 to tc7. A coil current ic6 flows through the diode DIbn and the transistor TRan from the times tc7 to tc1.

Here, at the time tc1, since the current only continues to flow through the diode DIbn, it becomes zero voltage switching with which a recovery loss does not occur. With a switching at the time tc3, since the current flowing through the transistor TRap flows through the diode DIan and the diode DIan only changes from the OFF state to the ON state, the recovery current does not occur. With a switching at time tc5, the current flowing through the diode DIan does not change. With a switching at the time tc7, since the diode DIbn only changes from the OFF state to the ON state, the recovery current does not occur. In addition, at the times tc2 and tc6, it become zero-current switching thus no recovery loss occurs.

Accordingly, there is no switching with which a diode changes from the ON state to the OFF state, thereby a recovery current does not occur.

The abnormal stop unit 92 (FIG. 4) stops the driving of each of the inverters 30, 31, 32, 33, 34, and 35, using the determination result of the phase difference determination unit 93. Specifically, the abnormal stop unit 92 performs abnormal stop when the low DC voltage Vdc, which is an input voltage, is equal to or greater than a predetermined value (e.g., equal to or greater than 50% of the high DC voltage Vmax) and a rising timing of the driving voltage waveform is advanced than the zero cross timing of the coil current. By lowering the output voltage (the low DC voltage Vdc) of the step-down chopper 10, the transient voltage is lowered and the destruction of the IGBT is avoided. In addition, by increasing the frequency of the square wave voltage, the operation becomes more inductive and the zero cross timing of the coil current is delayed, thus the phase lag state is ensured.

In addition, the abnormal stop unit 92 performs abnormal stop when the coil current is equal to or greater than a predetermined value (e.g., equal to or greater than 20% of the maximum current value) and in phase lead mode. In other words, the abnormal stop unit 92 does not perform abnormal stop even in phase lead mode while the coil current is less than a predetermined value, as the switching loss is small.

Modifications

The present invention is not limited to the embodiments described above, and various modifications such as following examples are possible.

(1) The aforesaid embodiment uses the IGBT as the switching element of the inverter, but a transistor such as a FET or a bipolar transistor may also be used.

(2) The aforesaid embodiment uses the step-down chopper 10 that lowers the voltage from the DC voltage, in order to supply DC power to the inverter, but it is possible to generate a DC voltage from the commercial power supply, using a forward transformer. In addition, as the commercial power supply, not only a single-phase power supply but also a three-phase power supply may be used.

(3) The aforesaid embodiment supplies the common low DC voltage Vdc to the inverters 30, 31, . . . , 35 corresponding to all induction heating coils 20, 21, . . . , 25, but it is also possible, by adding an induction heating coil requiring maximum heating amount and an inverter corresponding the induction heating coil, to supply the power of the high DC voltage Vmax to the added inverter and to supply the power of the low DC voltage Vdc to the inverters 30, 31, 32, . . . , 35.

What is claimed is:

1. An induction heating device comprising:

a plurality of induction heating coils which are disposed adjacent to each other;

capacitors each of which is connected in series to each of the induction heating coils;

a plurality of inverters each of which applies a high frequency voltage converted from a DC voltage to a series circuit of each of the induction heating coils and each of the capacitors; and a control circuit which performs a pulse width control of the high frequency voltage, as well as controls the plurality of the inverters so as to align phases of coil currents flowing through the plurality of the induction heating coils, respectively, wherein the control circuit is configured to vary the amplitude of the coil current by changing a control angle of the coil current, and wherein the DC voltage is common for the plurality of the inverters, and is decreased so that a maximum pulse width of all of high frequency voltages converted by the plurality of the inverters becomes equal to or greater than a predetermined value.

2. The induction heating device, according to claim 1, wherein the DC voltage is controlled such that a zero-cross timing at which a coil current flowing through the series circuit zero crosses from negative to positive is behind relative to a rising timing of a voltage applied to the series circuit.

3. The induction heating device, according to claim 1, wherein each of the plurality of the inverters comprises arms, each arm having a transistor, and a diode in a reverse parallel connection, and the DC voltage is generated by a chopper circuit or a converter.

4. The induction heating device, according to claim 1, further comprising an abnormal stop unit, which stops the plurality of the inverters when there is any inverter in which the high frequency voltage rises after a coil current zero-crosses from negative to positive.

5. The induction heating device, according to claim 1, wherein the plurality of the induction heating coils are disposed in proximity to a common heating element and the control circuit variably controls a pulse width of a square wave voltage as each of the high frequency voltages so that electromagnetic energies supplied to the heating element by each of the induction heating coils are uniformed.

6. An induction heating method for use in an induction heating device including a plurality of induction heating coils which are disposed adjacent to each other, capacitors each of which is connected in series to each of the induction heating coils, and a plurality of inverters each of which applies a high frequency voltage converted from a DC voltage to a series circuit of each of the plurality of the induction heating coils and each of the capacitors, the method comprising:

performing a pulse width control of the high frequency voltage, controlling the plurality of the inverters, each having the DC voltage in common, so as to align phases of coil currents flowing through the plurality of the induction heating coils, respectively, varying the amplitude of the coil current by changing a control angle of the coil current, and decreasing the DC voltage so that a maximum pulse width of all of high frequency voltages converted by the plurality of the inverters becomes equal to or greater than a predetermined value.

7. The induction heating method, according to claim 6, wherein the DC voltage is controlled such that a zero-cross timing of a current flowing through the series circuit is behind relative to a rising timing of a voltage applied to the series circuit.

8. A computer program, embodied on a computer-readable non-transitory medium, wherein the computer program is configured to execute a method for use in an induction heating device including a plurality of induction heating coils which are disposed adjacent to each other, capacitors each of which is connected in series to each of the induction heating coils, and a plurality of inverters each of which applies a high frequency voltage converted from a DC voltage to a series circuit of each of the plurality of the induction heating coils and each of the capacitors, the method comprising:

performing a pulse width control of the high frequency voltage, controlling the plurality of the inverters, each having the DC voltage in common, so as to align phases of coil currents flowing through the plurality of the induction heating coils, respectively, varying the amplitude of the coil current by changing a control angle of the coil current, and decreasing the DC voltage so that a maximum pulse width of all of high frequency voltages converted by the plurality of the inverters becomes equal to or greater than a predetermined value.

* * * * *